US006021718A

United States Patent [19]

Kröll et al.

[11] Patent Number: 6,021,718

[45] Date of Patent: Feb. 8, 2000

[54] TWO-AXLE UNDERCARRIAGE FOR TRACK-BOUND TRANSPORT SYSTEMS

[75] Inventors: Joachim Kröll, Jüchen; Hermann Franzen, Mönchengladbach; Gerlinde Pohlmann, Aachen; Peter Richter, Bergheim, all of Germany

[73] Assignee: Mannesmann Aktiengesellschaft, Düsseldorf, Germany

[21] Appl. No.: 09/010,230

[22] Filed: Jan. 21, 1998

[30] Foreign Application Priority Data

Jan. 21, 1997 [DE] Germany ..... 197 03 701

[51] Int. Cl.[7] ..... B61D 17/00

[52] U.S. Cl. ..... 105/3; 105/4.1; 105/4.2; 105/4.4

[58] Field of Search ..... 105/3, 4.1, 4.2, 105/4.4, 136, 165, 167, 168

[56] References Cited

U.S. PATENT DOCUMENTS

| | | | |
|---|---|---|---|
| 4,228,739 | 10/1980 | Fitzgibbon | 105/136 |
| 4,454,821 | 6/1984 | Dickhart, III | 105/168 |
| 4,787,318 | 11/1988 | Vogel | 105/136 |
| 4,998,483 | 3/1991 | Prins | 105/3 |
| 5,000,096 | 3/1991 | Urrea et al. | 105/3 |
| 5,638,757 | 6/1997 | Cortesi | 105/168 |

FOREIGN PATENT DOCUMENTS

| | | | |
|---|---|---|---|
| V 6157 II | 8/1953 | Germany . | |
| 195 05 495 | 8/1996 | Germany | B61F 3/12 |
| 195 20 549 | 10/1996 | Germany | B61D 3/16 |

*Primary Examiner*—Christopher P. Schwartz
*Assistant Examiner*—Robert J. McCarry, Jr.
*Attorney, Agent, or Firm*—Cohen, Pontani, Lieberman & Pavane

[57] ABSTRACT

A two-axle undercarriage for track-bound transport systems carrying freight and passenger traffic, especially for inseparable train units, is divided into two parts, each part housing a wheel set. The two undercarriage frame halves are connected to each other in an adjustably articulated fashion on the plane of travel and are axially movable relative to each other to a limited extent in the direction of travel. To provide a tensilely-strong connection of two adjacent car bodies of the track-bound transport system, a connecting rod is used that permits adjustment of the undercarriage frame halves. The connecting rod is arranged between the adjacent car bodies so that cardanic movement is permitted between each of the two adjacent car bodies so that cardanic movement is permitted between each of the two adjacent car bodies and the connecting rod.

10 Claims, 6 Drawing Sheets

TWO-AXLE UNDERCARRIAGE FOR TRACK-BOUND TRANSPORT SYSTEMS

BACKGROUND OF THE INVENTION

1. Field of the Invention

The present invention relates to a two-axle undercarriage for track-bound transport systems used in freight and passenger traffic. More specifically, the present invention relates to a two-axle undercarriage for inseparable train units carried on the undercarriage frames on which wheel sets are received, wherein at least one of the wheel sets is driven directly by a drive gear.

2. Description of the Related Art

Prior art two-axle undercarriages (which are also referred to as trucks) are known which have compact undercarriage frames on which wheel sets are mounted via wheel set bearings. In a standard swivel truck configuration, a car body is resiliently mounted in a swiveling ring on the swivel truck frame with secondary springs between the swivel truck and the car body. The wheel sets are resiliently mounted in the swivel truck frames using primary springs. The wheel sets are driven by wheel set gears. In these standard swivel trucks, the wheel sets are not steered on curves either actively or passively.

The development of track-bound transport systems in the form of inseparable train units (such as commuter, ICE, and STE trains) has created a need for new undercarriages that support two car bodies at once. Prior art trucks known as Jacobs swivel trucks have the above characteristics for supporting two adjacent car bodies. These trucks are used for supporting streetcars. However, the Jacobs swivel trucks and other conventional designs are complicated, heavy, and therefore expensive, making them undesirable for use on the commuter, ICE, and STE trains, for example.

SUMMARY OF THE INVENTION

The object of the present invention is to provide a new undercarriage design for supporting two adjacent car bodies and for use with generic transport systems, including inseparable trains, which includes a simple design, easy assembly, good maintenance characteristics and economical production. The new undercarriage is to be lighter than conventional swivel trucks, designed for high wheel loads, and is also to have good ground running characteristics.

To attain this object, it is proposed according to the invention that the undercarriage frame be divided into two halves between the wheel sets and that one wheel set be arranged in each half of the undercarriage frame. It is further proposed that the two undercarriage frame halves be pivotally adjustably connected to each other on the plane of travel, and also that the two halves be connected to each other in the direction of travel so as to be movable toward and away from each other to a limited extent. Further, it is proposed that the adjacent car bodies supported by the undercarriage be connected to each other in a tensilely-strong manner with a connecting rod that permits adjustment of the undercarriage frame halves arranged between the adjacent car bodies in a cardanically movable fashion.

The undercarriage according to the invention differs from previous undercarriages in its two-part torsionally-jointed and adjustably-jointed undercarriage frame which permits each individual wheel set to have high mobility. The undercarriage travels well on curves and, because of the two-part design of its frame, is especially suitable for modern inseparable train units.

In an especially advantageous embodiment of the invention, each half of the undercarriage frame comprises a housing that houses a wheel set. The wheel set and, as applicable, the associated wheel set gear are mounted in the housing, while a car body of the train unit is supported on the housing via hydraulic spring elements.

Because the undercarriage frame, the wheel set housing and the gear housing, which were previously separate components, are now combined in a single housing, this single housing performs multiple functions and enables a simple design at which the invention aims. Hydraulic spring elements are known, and are often used in truck-mounted and mobile cranes. Such spring elements are especially well-suited for the undercarriage of the present invention because they have a small space requirement that can be easily integrated into the novel design of the invention. Constructing the undercarriage frame from two housings that are adjustable relative to each other enables the mounting of the wheel set on the inner side of the wheels and, at the same time, permits the wheel set gear to be housed in a very compact structural unit.

According to a further feature of the invention, a pivot joint with a vertical pivot joint journal is provided between the housings. Articulated halves of the pivot joint are connected to each other by bolts that are attached to one of the housings or pivot joint and can be inserted into axis-parallel borings in the other of the housing or pivot joint. The bolts are movable within the borings to a limited extent and permit the two housings to move toward each other and to turn relative to each other.

The pivot joint permits relative angular mobility of the housings and also allows the housings to be turned toward each other around a common axis lying in the direction of travel. The bolt-boring connection also permits limited axial movement of the housings toward or away from each other during travelling operation.

Because of the axial mobility of the pivot joint connection of the housings, tensile forces are transmitted from one car body to the other using a connecting rod connecting the car bodies of the train unit on both sides by radial articulated bearings. The connecting rod has two beams, which are arranged on a horizontal plane at a distance from each other. Between the beams, a cross-traverse is arranged that is pivotable around its longitudinal axis, which runs at a right angle to the longitudinal axis of the connecting rod. The cross-traverse has a center guide boring for receiving the pivot joint journal of the pivot joint provided between the housings. The pivot joint journal penetrates the center guide boring of the cross-traverse.

According to the invention, the connecting rod between the car bodies bears buffer strokes of up to 200 tons (t) and connects the car bodies of the train unit. Embodying the connecting rod with two beams and a cross-traverse to accommodate the vertical pivot joint journal allows the two car bodies to move vertically relative to each other during travel.

To transmit travelling and braking forces from the wheel sets to the car bodies, pressure or tensile supports are provided between the car bodies and the housings of the undercarriage frame halves, according to another feature of the invention.

Preferably, and according to another feature of the invention, the wheel sets are driven via drive motors flanged laterally onto at least one housing, and the output journals of such drive motors are connected directly to the wheel set gears mounted in the housings.

Hydrostatic driving motors designed as travelling and braking drives can be used to drive the wheel sets, as can electric motors.

Although the hydrostatic driving motors are designed as travelling and braking drives, it is advantageous to provide emergency or stopping brakes in the form of disk brakes that act upon at least one wheel of the wheel set and are attached to the housing of each respective undercarriage frame half.

It has been found that the best travelling behavior of the undercarriage according to the invention can be achieved by maintaining the following geometric conditions for the length L of the connecting rod $$L=a-[a^2/(a+b)]$$

where: a=the distance between wheel sets in the undercarriage, and b=the distance between wheel sets in the car body.

The undercarriage according to the invention provides an especially simple undercarriage with extremely advantageous curve travel that meets all requirements of modern transport systems. The undercarriage can be manufactured economically and is lighter than standard swivel trucks. Simplification and weight reduction are achieved, in particular, by the fact that many components of the undercarriage according to the invention have a double function. For instance, the gear housing and undercarriage frame are combined in the present invention. The two housings of the undercarriage frame halves, and thus the gear housings in which the wheel sets are also mounted, rest directly against each other. Guide devices are combined in the connecting rod and in the tensile-pressure supports. The use of hydropneumatic springs simplifies the design, and a very compact and easily maintained undercarriage is created.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings, wherein like reference numerals denote similar elements throughout the several views.

DETAILED DESCRIPTION OF THE PRESENTLY PREFERRED EMBODIMENTS

Figure 1:
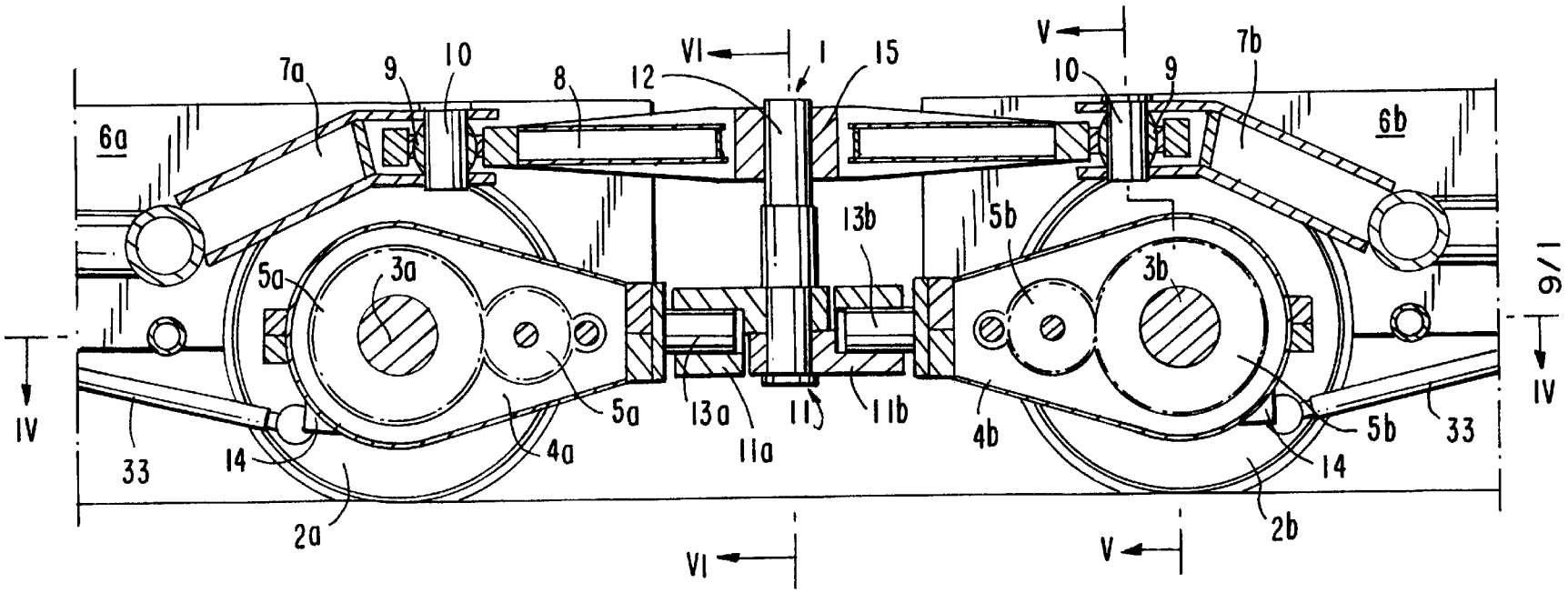
FIG. 1 shows a longitudinal section through the undercarriage according to an embodiment of the invention.

FIG. 1 shows a longitudinal section through an undercarriage 1 according to the invention. Two wheels of wheel sets 2*a*, 2*b* are shown with corresponding axles 3*a*, 3*b* mounted in housings 4*a*, 4*b*. Housing 4*a*, 4*b* form referred to as the two undercarriage frame halves of the undercarriage according to the invention. Also arranged in the housings 4*a*, 4*b*, in addition to the wheel axles 3*a*, 3*b* of the wheel sets 2*a*, 2*b*, are wheel set gears 5*a*, 5*b*, which may be driven via the respective driving journals of hydraulic motors (the journals and hydraulic motor are not shown in FIG. 1.

Figure 2:
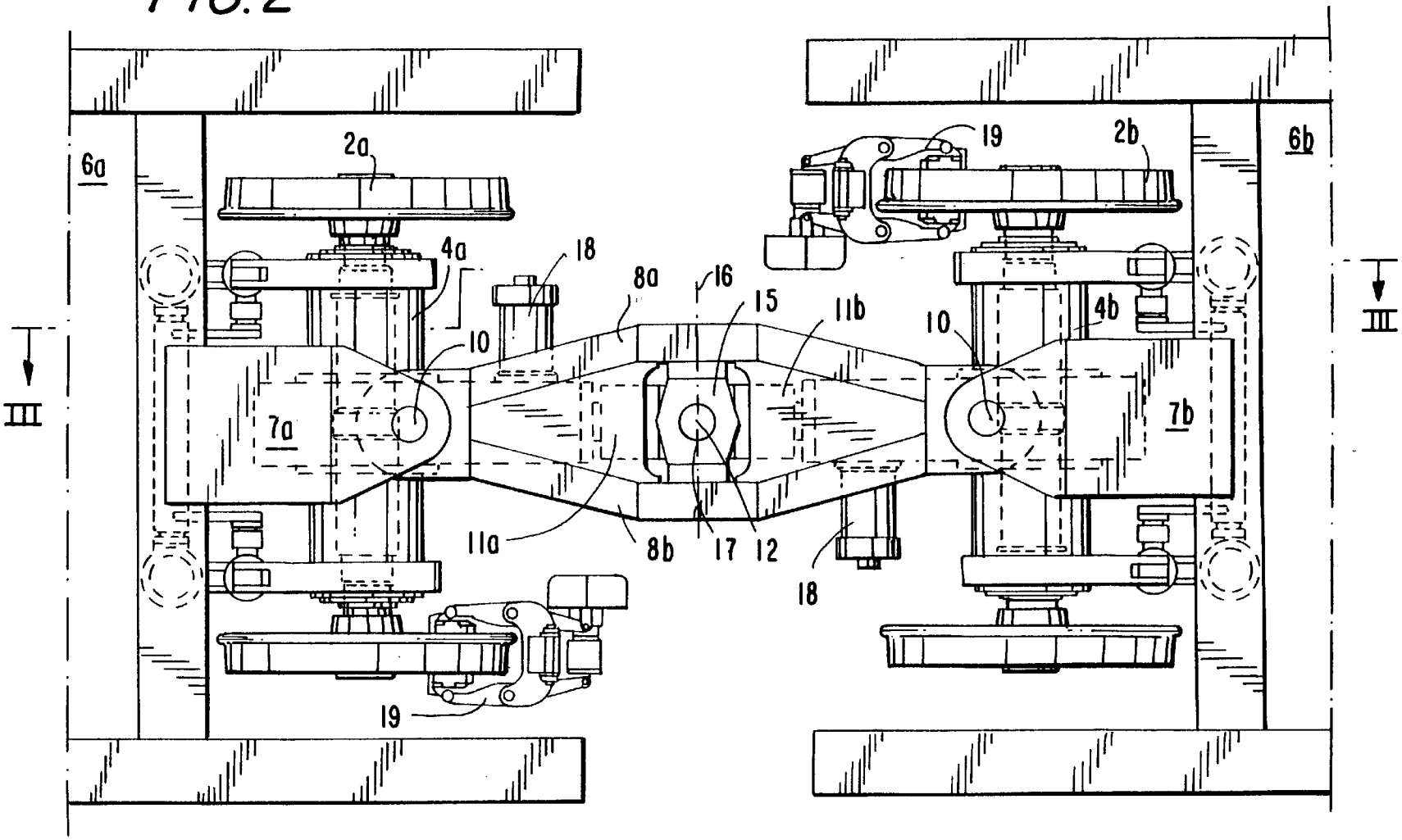
FIG. 2 is a top view of the embodiment of the undercarriage in FIG. 1.
Figure 7:
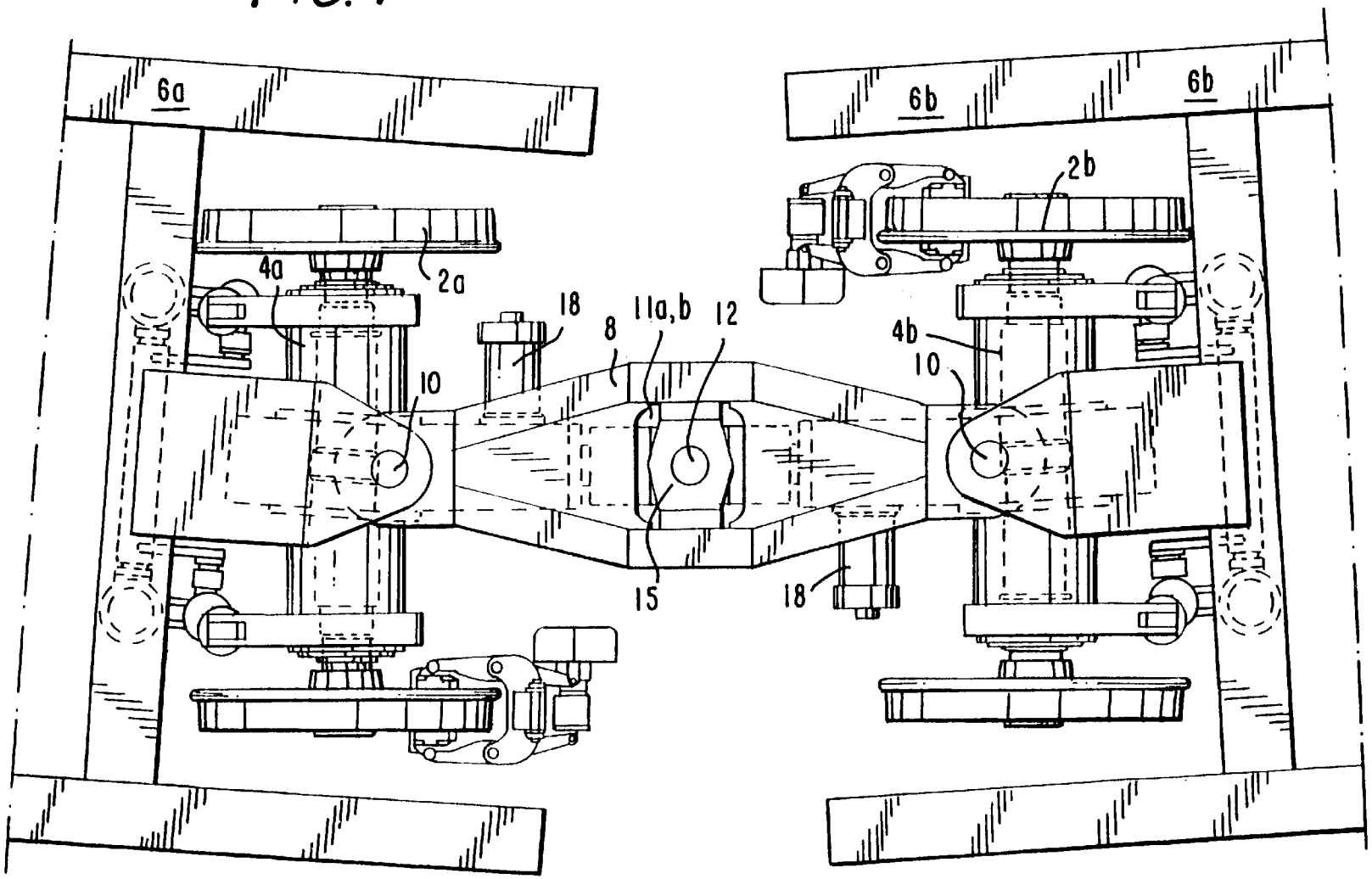
FIG. 7 shows a top view of the undercarriage according to the invention, travelling on a curve.

FIG. 1 also shows, in schematic fashion, car bodies 6*a*, 6*b*, whose frame parts are connected at each end to frame parts 7*a*, 7*b* via a cardanic connection, including radially articulated bearings 9 and bolts 10. The cardanic connection relates to a cardan joint which is a universal joint including a cross-like piece in which each of the two sets of opposing ends rotate respectively within the forked ends of two connected shafts. In the present arrangement, the bolts 10 comprise the cross-like piece connected to bearings 9 on the connecting rod 8 and the frame parts 7*a*, 7*b*. This arrangement allows pivoting of each frame part 7*a*, 7*b* about any axis perpendicular to a longitudinal axis of the connecting rod 8, i.e. cardanic movement. This is shown in the Figures in that FIGS. 2 and 7 show that the frame parts 7*a*, 7*b* can pivot about a vertical axis relative to the substantially horizontal connecting rod and in that FIG. 1 shows the bearing 9 mounted on the bolt 10 so that the frame parts 7*a*, 7*b* can pivot about a transverse horizontal axis. In this configuration, the connecting rod 8 is capable of transmitting very high tensile and pressure forces between the car bodies 6*a*, 6*b*.

A two-part pivot joint 11*a*, 11*b* (collectively referred to as pivot joint 11) is connected between the housings 4*a*, 4*b* on the housing sides that face each other. The pivot joint 11 is pivotable in the manner of a hinge about a vertical pivot joint journal 12. The vertical pivot journal 12 extends upward into the area of the connecting rod 8. That connection is described more fully below.

Each part of the two-part pivot joint 11*a* and 11*b* is bored on the sides that face the housings 4*a*, 4*b*. The borings in the two part pivot joint 11 are coaxial to respective bolts 13*a* and 13*b*, which are arranged in axis-parallel fashion on the two housings 4*a*, 4*b*. The bolts 13*a*, 13*b* are inserted into the borings of the two-part pivot joint 11*a*, 11*b* and are axially displaceable by certain limited amounts, thereby permitting the housings 4*a*, 4*b* to turn about the common longitudinal central axis of the bolts 13*a*, 13*b*.

Tensile and pressure supports 14 acting upon the housings 4*a*, 4*b* through rods 33 bear the travelling and braking forces generated between the car bodies 6*a*, 6*b* of the train units and the housing 4*a*, 4*b* during motion of the train.

Referring also to FIG. 2, the connecting rod 8 is divided into two separated beams 8*a*, 8*b*, which converge at their ends in the region of the bolts 10. A cross-traverse 15 is connected between the beams 8*a*, 8*b*, which is pivotable about an axis 16 that is perpendicular to the longitudinal axis of the connecting rod 8. A guide boring 17 in the center of the cross-traverse 15 receives the pivot joint journal 12 of the pivot joint 11. The pivot point journal 12 is inserted in guide boring 17 in an axially movable fashion.

FIG. 2 also shows hydraulic motors 18 that are flanged onto both sides of the housings 4*a*, 4*b* in the region of the drive gears 5*a*, 5*b*.

Disk brakes 19 are mounted about one wheel of each wheel set 2*a*, 2*b*. The disk brakes 19 act upon the one wheel of the wheel sets 2*a*, 2*b* and serve as emergency or stopping brakes. The disk brakes 19 are mounted by mountings (not shown in FIG. 2) for support in respective housings 4*a* and 4*b*.

Figure 3:
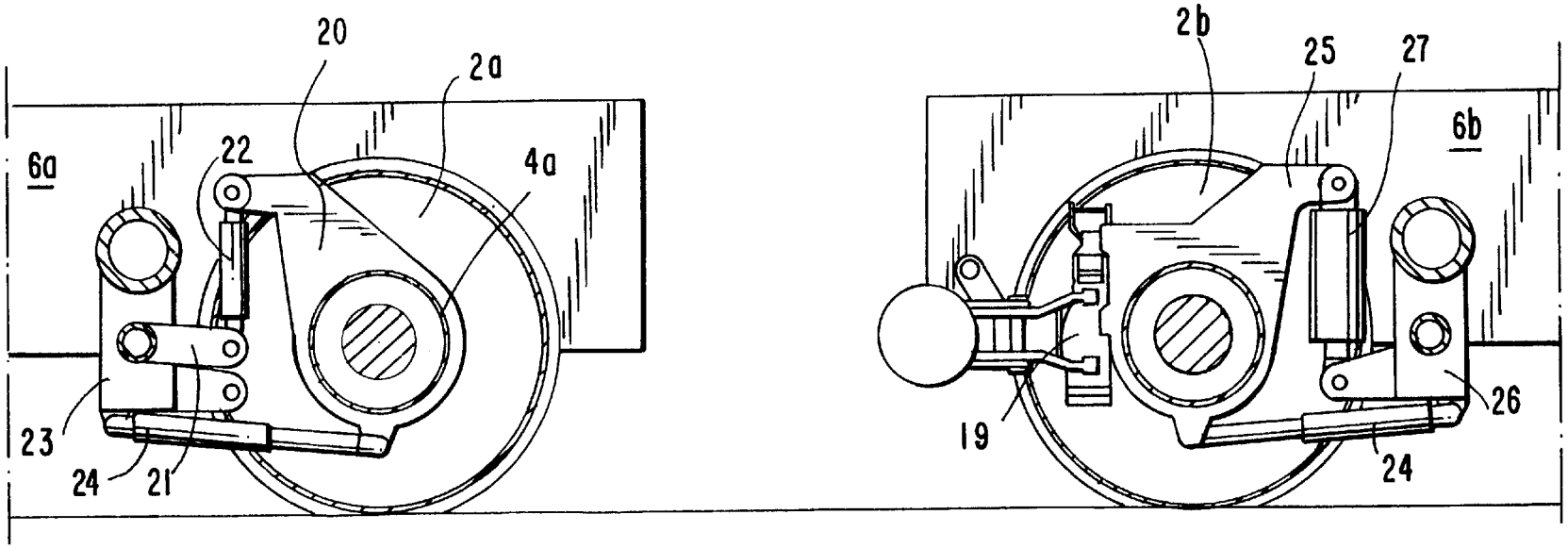
FIG. 3 shows a section of the undercarriage through line III—III of FIG. 2.

FIG. 3 shows a section through the wheel sets 2*a*, 2*b* on different planes. The left half of the drawing shows a cantilever 20 welded to the housing 4*a*. A damper 22 is connected between the cantilever 20 and a roll rod 21, which prevents rolling motions of the vehicle. The roll rod 21 itself is attached to a bearing support 23 which is connected to car body 6*a* and serves as a counter-bearing for the swivel truck suspension. A longitudinal damper 24 is arranged on the car body between the bearing support 23 and the housing 4*a*. Although it is not shown in FIG. 3, this arrangement of parts is arranged at each wheel of the undercarriage 1. The right half of FIG. 3, is one of four spring supports for the car body on the housing 4*b*. The spring supports are also associated with each wheel of the undercarriage 1. Each spring support comprises a cantilever 25 welded to the housing 4*b*, a hydraulic cylinder 27 connected between the cantilever 25 and a bearing support 26, which is attached securely to the car body 6*b*.

Figure 4:
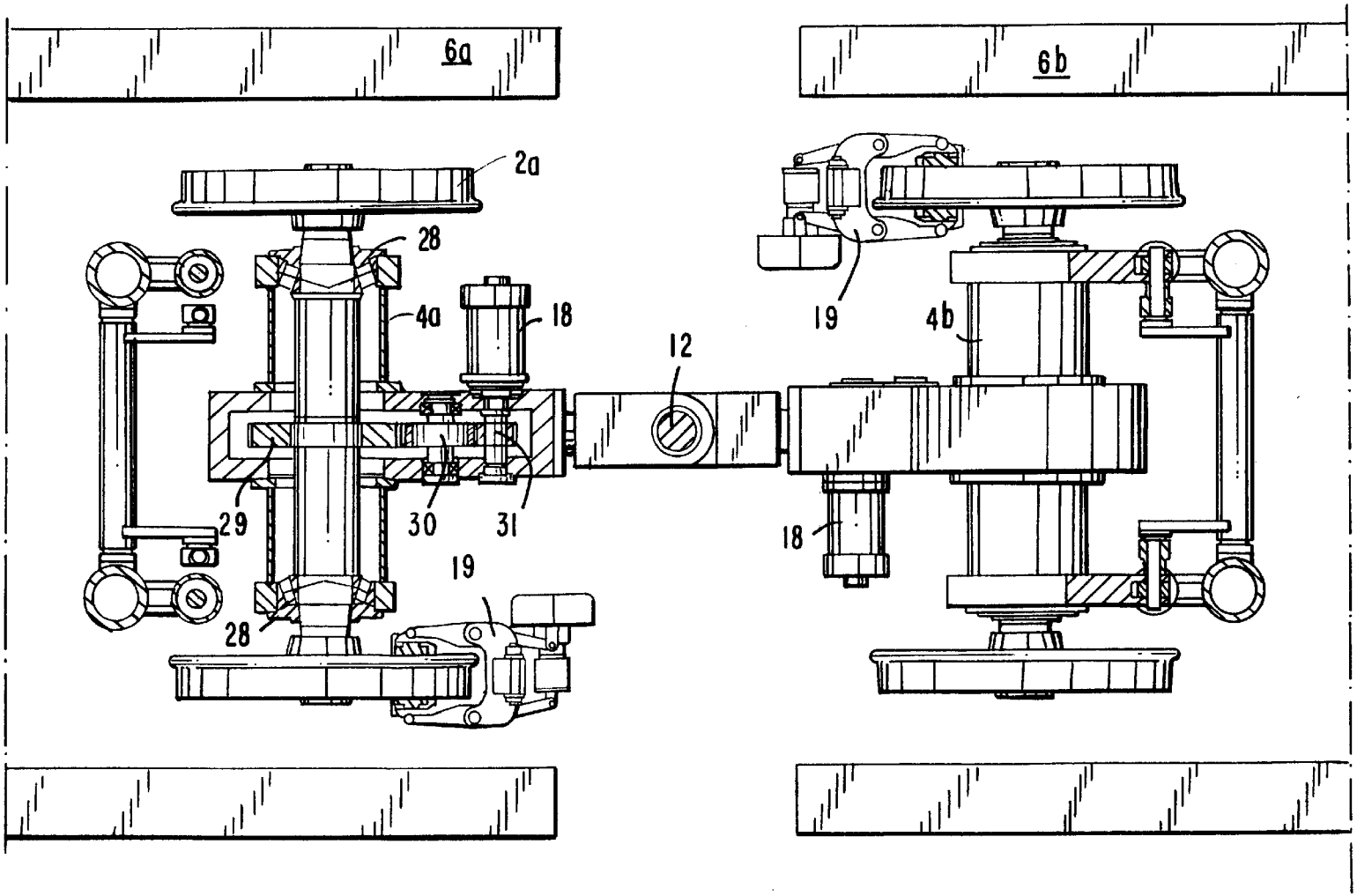
FIG. 4 shows a top view of a horizontal section of the undercarriage housing through line IV—IV of FIG. 1.

FIG. 4 shows a top view of a section through the housing according to the invention. The wheel set 2*a* is clearly shown as mounted on wheel axles 3*a* in the housing '4*a* in the spherical roller bearings 28. A gearwheel 29 of the gear, 5*a*, with which driving moment is conducted from the hydraulic motor 18, is connected to the axle 3*a* of the wheel set 2*a*. The axle is driven by the hydraulic motor 18 via an output journal 31 and an intermediate gearwheel 30. Each gear housing thus serves for mounting the gear and also for bearing the wheel set 2*a* and, at the same time, constitutes one half of the undercarriage frame of the undercarriage according to the invention.

Figure 5:
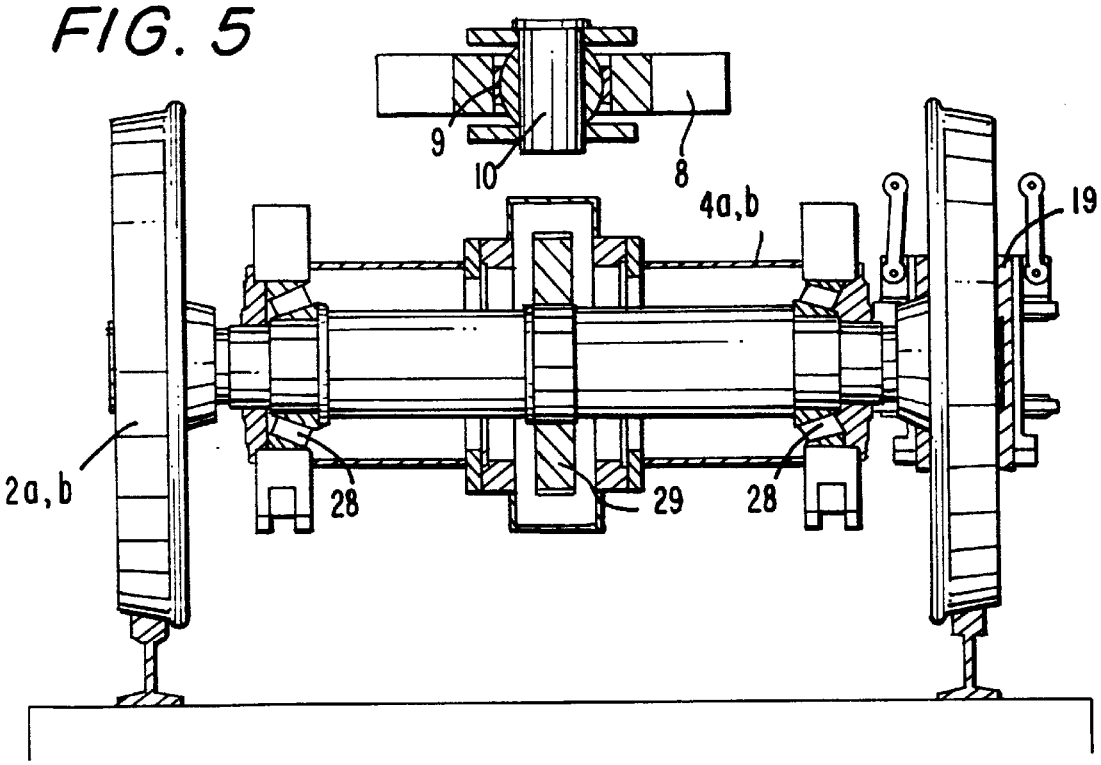
FIG. 5 shows a vertical section of the undercarriage through line V—V of FIG. 1.
Figure 6:
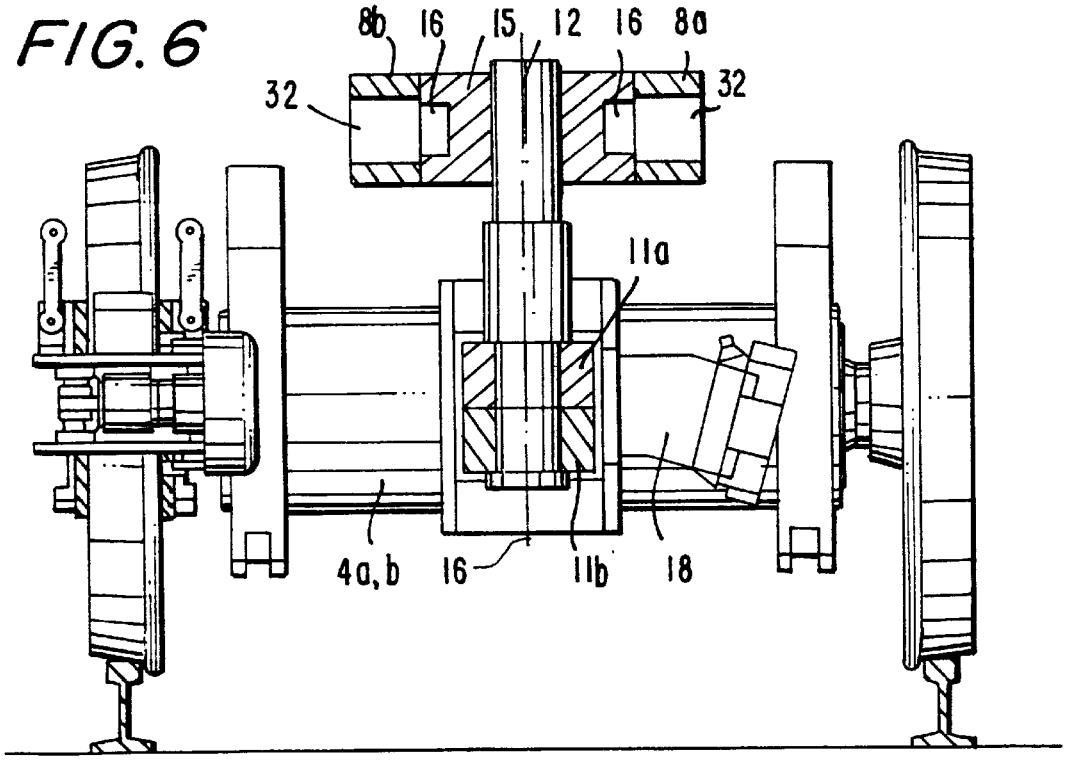
FIG. 6 shows another vertical section of the undercarriage through line VI—VI of FIG. 1.

FIG. 5, which is a vertical section through the connection of the connecting rod 8 in the area of one of the bolts 10, shows a radial articulation 9, which permits free adjustment of the connecting rod 8. The housing 4*a*, 4*b* is sectioned in the area of the wheel set 2*a*, 2*b*, so that the bearing 28 of the wheel set 2*a*, 2*b*, as well as the arrangement of the gearwheel 29 on the axle of the wheel set 2*a*, 2*b* are also shown. FIG. 6 shows a section through the cross-traverse 15 of the connecting rod 8. The beams 8*a*, 8*b* of the connecting rod 8 are connected by journals 32 to the cross-traverse 15. The front ends 16 of the journals 32 extend into corresponding borings in the cross-traverse 15, thereby permitting pivoting of the cross-traverse 15 about the axis 16. Below this, the drawing shows the extension of the pivot joint journal 12 and its arrangement in the pivot joint 11*a*, 11*b*, with which enables an angular adjustment of the wheel sets relative to each other.

FIG. 7 shows a top view of the undercarriage according to the invention when travelling on a curve. When travelling on a curve, the center of the wheel sets in the undercarriage adjusts to the curve radius. The difference between the wheel set spacing $\alpha$ and the connecting rod length L causes a lateral excursion of the connecting rod 8. Thanks to the coupling of the pivot joint 11*a*, 11*b* to the traverse 15 by means of the pivot joint journal 12, the excursion movements of the connecting rod 8 are necessarily transmitted to the housings 4*a*, 4*b*, so that the wheel sets 2*a*, 2*b* adjust to the particular curve radius. For all curve radii, the following equation applies:

$$L=a-[a^2/(a+b)]$$

where: a=the distance between wheel sets in the undercarriage, and b=the distance between wheel sets in the car body.

The invention is not limited by the embodiments described above which are presented as examples only but can be modified in various ways within the scope of protection defined by the appended patent claims.

We claim:

1. A two-axle undercarriage for a track-bound transport system for carrying freight and passengers loads, comprising:

an undercarriage frame divided into two undercarriage frame halves operatively connected at a connection for pivoting about said connection on a plane of travel and for moving axially relative to each other for a limited distance along a direction of travel, said two undercarriage frame halves include housings having spring elements for supporting respective ends of two adjacent car bodies of said track-bound transport system;

a wheel set rotatably connected to each of said housings of said two undercarriage frame halves;

a wheel set gear rotatably mounted in said undercarriage frame on at least one of said two housings of said two undercarriage frame halves and drivably connected to said wheel set of said at least one of said two undercarriage frame halves;

a connecting rod having two ends connectable to the two adjacent car bodies via cardanic connections for transmitting forces between the adjacent car bodies and permitting cardanic movement of each of the two adjacent car bodies with respect to the connecting rod, said connecting rod operatively connected to said under carriage between said two undercarriage frame halves.

2. The two-axle undercarriage for a track-bound transport system of claim 1, wherein said connection further comprises a pivot joint connected to said two undercarriage frame halves with a vertical pivot joint journal;

said pivot joint comprising articulated halves which are connected to said two undercarriage frame halves via bolts insertable into axis-parallel borings in one of said two undercarriage frame halves and said pivot joint articulated halves and attached to the other one of said undercarriage frame halves and said pivot joint articulated halves; and said bolts operatively connected for axial movement in said borings to a limited extent for permitting a relative movement of said two undercarriage frame halves toward or away from each other.

3. The two-axle undercarriage for a track-bound transport system of claim 2, wherein said connecting rod connects to each of said adjacent car bodies of said track-bound transport system with radial articulated bearings and comprises two beams arranged at a distance from each other on a horizontal plane;

a cross-traverse is operatively connected between said two beams for pivoting around an axis running perpendicularly to the longitudinal axis of said connecting rod; and a center of said cross-traverse includes a guide boring for receiving said vertical pivot joint journal of said pivot joint.

4. The two-axle undercarriage for a track-bound transport system of claim 1, further comprising tensile and pressure supports operatively connected between said car bodies and said undercarriage for transmitting travelling and braking forces between car bodies and said undercarriage housings.

5. The two-axle undercarriage for a track-bound transport system of claim 1, further comprising at least one of a longitudinal damper and a vertical damper operatively connected between said undercarriage and said car bodies for damping vibrations.

6. The two-axle undercarriage for a track-bound transport system of claim 1, further comprising driving motors operatively connected for driving said wheel sets, said driving motors being flanged laterally onto at least one of said two undercarriage halves and having output journals directly connected to said wheel set gear.

7. The two-axle undercarriage for a track-bound transport system of claim 1, further comprising hydrostatic driving motors, which are designed as a travelling and a braking drive, operatively connected to said wheel set gear.

8. The two-axle undercarriage for a track-bound transport system of claim 1, further comprising electric motors operatively connected to said wheel set gear.

9. The two-axle undercarriage for a track-bound transport system of claim 1, further comprising disk brakes operatively connected to at least one wheel of said wheel set of each of said undercarriage frame halves and fixedly connected to said each of said undercarriage frame halves, for providing emergency or stopping brakes.

10. The two-axle undercarriage for a track-bound transport system of claim 1, wherein a length L of said connecting rod complies with the following equation:

$$L=a-[a^2/(a+b)]$$

where: a=a distance between said wheel sets in said two-axle undercarriage, and b=a distance between said wheel sets in a car body of said track-bound transport system.

* * * * *